United States Patent [19]

Yamamoto

[11] Patent Number: 4,498,202

[45] Date of Patent: Feb. 12, 1985

[54] HELMET EQUIPPED WITH VENTILATOR

[75] Inventor: Tamenobu Yamamoto, Higashi-Osaka, Japan

[73] Assignee: Yamamoto Kogaku Co., Ltd., Higashi, Japan

[21] Appl. No.: 469,246

[22] Filed: Feb. 24, 1983

[51] Int. Cl.[3] ..... A42B 3/02

[52] U.S. Cl. ..... 2/424; 2/437; 2/171.3

[58] Field of Search ..... 2/171.3, 424, 410, 436, 2/437, 6, 8, 10

[56] References Cited

U.S. PATENT DOCUMENTS

| | | | |
|---|---|---|---|
| 3,238,535 | 3/1966 | Richey | 2/8 |
| 3,629,868 | 12/1971 | Greenlee | 2/171.3 X |
| 3,825,953 | 7/1974 | Hunter | 2/437 |
| 3,838,466 | 10/1974 | Poirier | 2/10 |
| 3,963,021 | 6/1976 | Bancroft | 2/171.3 X |
| 4,083,065 | 4/1978 | Warncke | 2/424 |
| 4,115,874 | 9/1978 | Hasegawa | 2/171.3 X |
| 4,136,688 | 1/1979 | Gorman | 2/171.3 X |

FOREIGN PATENT DOCUMENTS

| | | | |
|---|---|---|---|
| 3046046 | 7/1982 | Fed. Rep. of Germany | 2/436 |

*Primary Examiner*—Peter Nerbun

*Attorney, Agent, or Firm*—Armstrong, Nikaido, Marmelstein & Kubovcik

[57] ABSTRACT

A helmet having a shell and a face shield for closing an opening of the shell and equipped with a ventilator for ventilating the space between the face shield and the face of the wearer of the helmet. The air flowing into or out of the space for ventilation forms a stream along the inner surface of the face shield.

8 Claims, 9 Drawing Figures

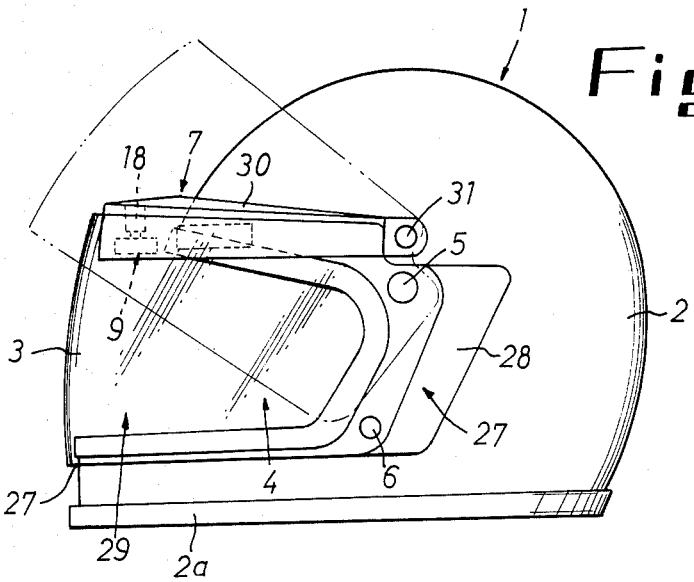
Fig. 8
Fig. 5
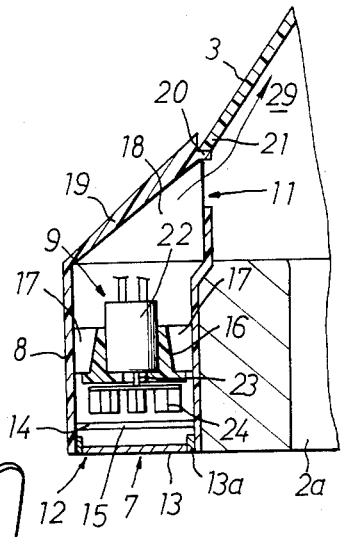
Fig. 9
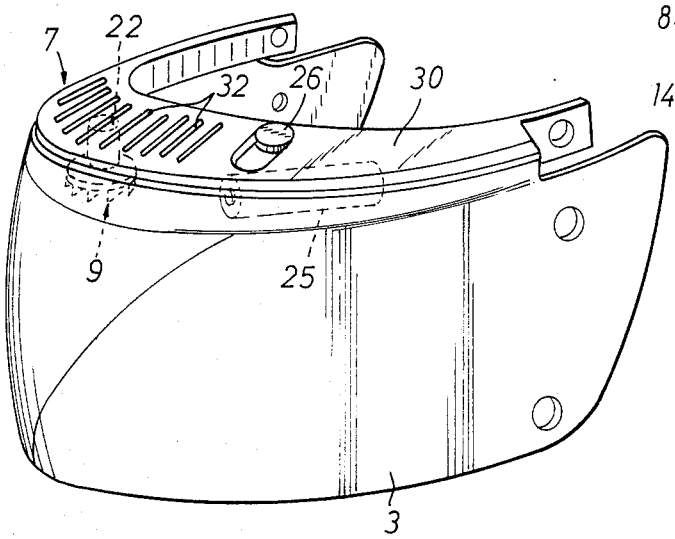

HELMET EQUIPPED WITH VENTILATOR

BACKGROUND OF THE INVENTION

The present invention relates to a helmet equipped with a ventilator, and more particularly to a helmet useful for motorcycle riders.

Helmets heretofore known for motorcycle riders include those of the full-face type having a face shield for entirely covering the face of the rider and effective for protecting the rider from the wind and dust. The helmet of this type comprises a cap-shaped shell adapted to fit over the head of the wearer and formed with an opening closable with the face shield for covering the face of the wearer, and a protector portion extending from the shell and opposed to the chin of the wearer, so that the space between the face shield and the face can not be ventilated satisfactorily. Accordingly the helmet has the likelihood that the face shield will sometimes fog up to result in poor visibility. Stated more specifically, the rider perspired to fog the inner surface of the face shield during the hot summer season. During running in winter or in cold climate, the face shield is cooled, whereas the breath and heat are confined in the space between the shield and the face to fog up the inner surface of the face shield.

SUMMARY OF THE INVENTION

An object of the present invention is to provide a helmet having a face shield and equipped with a ventilator for forcibly ventilating the space between the face shield and the face of the wearer to prevent the face shield from fogging. For this purpose, the ventilator of the invention comprises a case attached to the shell of the helmet and having an inside opening open to the inside of the face shield and outside opening communicating with the inside opening and open to the outside of the helmet, and air passing means including an electric motor and a fan which are accommodated in the case. The air flowing through the space between the face shield and the face is caused to form a stream along the inner surface of the face shield by the air passing means. The fan of the air passing means is reversibly rotatable. When driven forward, the fan serves as a blower for drawing atmospheric air into the case through the outside opening and supplying the air to the inner surface of the face shield from the inside opening. When driven reversely, the fan serves as an induced draft blower for forcing out air from the space through the inside opening of the case and discharging the air from the outside opening. When the fan is driven forward, it is desirable that the air be uniformly forced against the shield inner surface. To assure this, the case is provided with a plurality of flow guide plates arranged at its inside opening laterally thereof at a spacing.

For improved productivity, it is advantageous to assemble the ventilator as a unit and mount the unit on the helmet. In order to effectively prevent the face shield from fogging, an expedient is used by which the flow of air produced by the air passing means is caused to form a stream along the inner surface of the face shield.

Helmets of the full-face type have a protector portion on the shell which portion is positioned at the chin of the wearer. The ventilator unit of the invention can be incorporated in the protector portion. In this case, a clearance is formed at each side end of the face shield between the shield and the helmet shell. The air flowing between the clearance and the inside opening of the case forms a stream along the inner surface of the face shield.

Further according to the invention, a pair of ventilator units can be provided individually at opposite side ends of the face shield between the shield and the helmet shell. Each of the ventilator units is fixedly accommodated in a recessed portion formed in the shell. A clearance is formed between the lower edge of the face shield and the projector portion of the shell. The air flowing between the clearance and each ventilator unit forms a stream along the inner surface of the face shield.

Further according to the invention, the ventilator can be incorporated in a visor projecting above the opening of the helmet shell. In this case, the visor per se provides a case for the ventilator. Thus the assembly of the visor and the ventilator is in the form of a unit. The face shield is bulged from the shell opening, and a clearance is formed between the lower edge of the shield and the protector portion of the shell. The visor is formed with air ports opposed to the air passing means. The air flowing between the air ports and the clearance under the shield lower edge forms a stream along the inner surface of the face shield.

Other objects and features of the invention will become apparent from the following description.

BRIEF DESCRIPTION OF THE DRAWINGS

FIG. 5 is a view in vertical section taken along the line V—V in FIG. 3 and showing the ventilator;

FIG. 8 is an overall side elevation showing a helmet equipped with a ventilator according to a third embodiment of the invention; and FIG. 9 is a perspective view showing a face shield and a ventilator unit incorporated in a visor according to the third embodiment.

DESCRIPTION OF THE PREFERRED EMBODIMENTS

Figure 1:
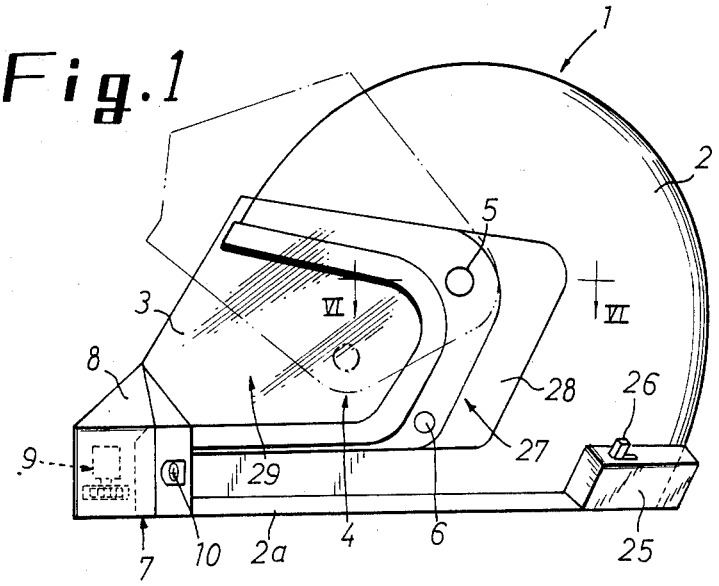
FIG. 1 is an overall side elevation showing a helmet equipped with a ventilator embodying the invention.
Figure 2:
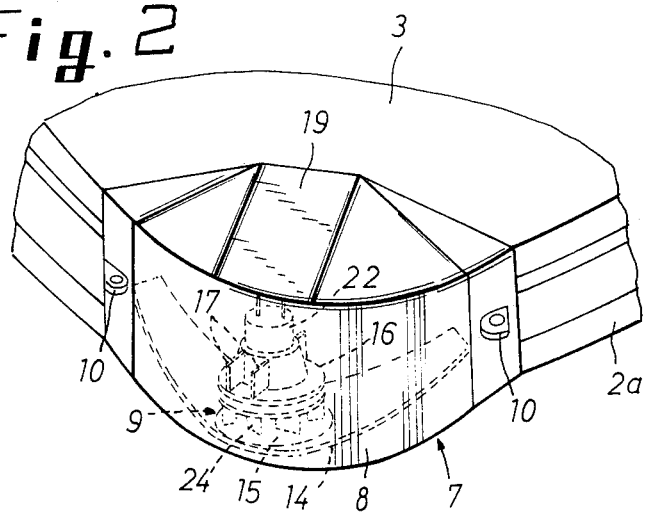
FIG. 2 is a perspective view showing the ventilator.
Figure 6:
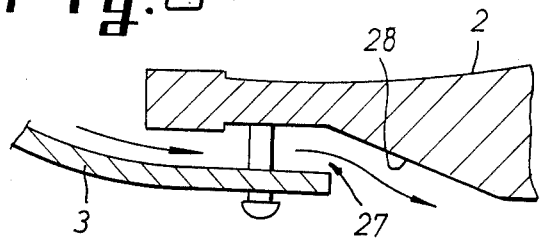
FIG. 6 is an enlarged view in cross section taken along the line VI—VI in FIG. 1 and showing a side end portion a face shield and a helmet shell portion.
Figure 3:
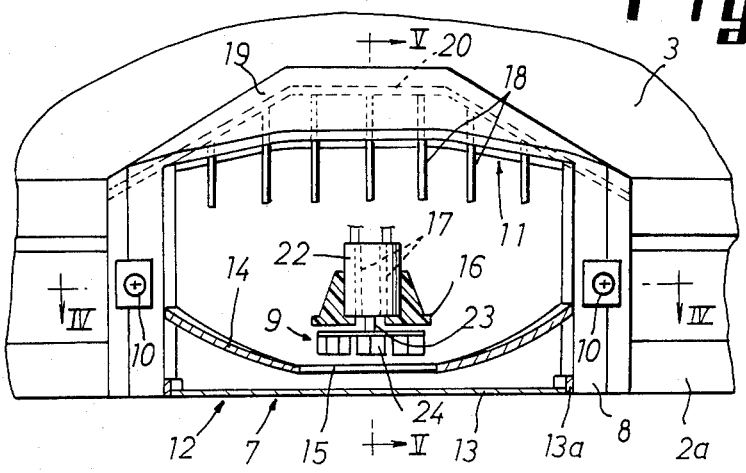
FIG. 3 is a view in vertical section showing the ventilator.
Figure 4:
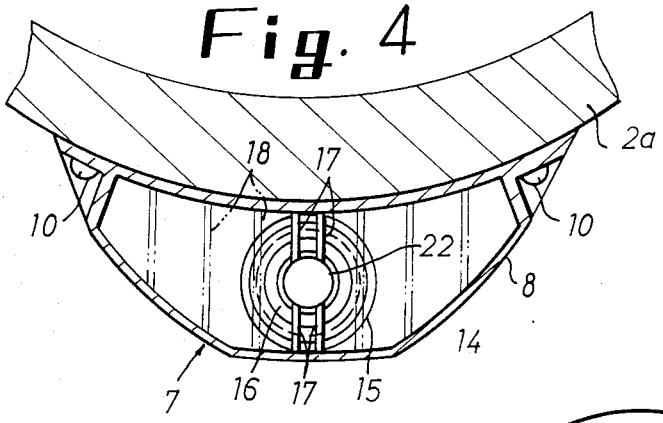
FIG. 4 is a view in cross section taken along the line IV—IV in FIG. 3 and showing the ventilator.

FIGS. 1 to 6 show a first embodiment of the invention. A helmet 1 has a rigid shell 2 and a face shield 3. The shell 2 is in the form of a cap fitting over the head of the wearer (rider) and is formed with an opening 4 for exposing the face of the wearer. Under the opening 4, the shell 2 has a protector portion 2*a* positioned at the chin of the wearer and integral with the shell 2. Alternatively the protector portion 2*a* is separate from the shell 2 and is removably fixed to the shell 2 although not shown. The face shield 3 is in the form of a transparent or opaque resin plate and openably closes the opening 4 of the shell 2. Thus the helmet is of the full-face type. The face shield 3 is pivoted at its upper opposite corners to the shell 2 by pins 5 and is thereby made turnable from a closed position indicated in solid lines in FIG. 1 to an opened position indicated in broken line in FIG. 1. The shield 3 is locked in the closed position by snap means 6. The shield 3 is holdable in its opened position by the frictional resistance between the shield 3 and the shell 2 at the pivoted portions 5.

A ventilator 7 is in the form of a unit comprising a case 8 and air passing means 9 accommodated in the case and including an electric motor 22 and a fan 24. The ventilator unit is fixed to the front side of the shell protector portion 2*a* with screws 10. The case 8 has an inside opening 11 open to the inside of the face shield 3 and a lower outside opening 12 communicating with the inside opening 11 and open to the outside of the helmet. Preferably the outside opening 12 is closed with a dust removing air filter 13 held by an outer frame 13*a*. Positioned above the filter 13 close thereto is an intermediate wall 14 formed in the interior of the case 8. The intermediate wall 14 has an aperture 15 formed in its center portion which is bulged downward. Disposed within the case 8 above the wall 14 is a hollow conical support member 16 for supporting the motor 22. The support member 16 has ribs 17 projecting from its outer periphery and securing the member 16 to the inner surface of the case. The case 8 is internally provided with a plurality of flow guide plates 18 arranged at its inside opening 11 laterally thereof side by side at a spacing. The case has a slanting front wall 19 formed with a groove 20 in its upper edge. The face shield 3 is cut out in the form of a recess to provide an edge 21 which is shaped in conformity with the shape of the case 8 and which is fitted in the groove 20. The air passing means 9 is mounted on the support member 16. The motor 22 is removably inserted in the center of the support member 16 and has an output shaft 23 projecting toward the aperture 15 and fixedly carrying the fan 24. The fan 24 is preferably an axial-flow propeller fan but can be a sirocco fan, centrifugal fan or the like. Power supply means 25 is attached to a side portion of the helmet shell 2 and connected to the motor 22 for supplying power thereto. A switch 26 energizes or de-energizes the motor 22 and further rotates the motor 22 selectively forward or reversely. The power supply means 25 may be separate from the helmet 1 and attached to a suitable portion of the body of the rider. Alternatively the battery of the motorcycle can be utilized.

A clearance 27 is formed at each side end of the face shield 3 between the shield and the helmet shell 2 by forming a recess 28 in the corresponding side portion of the shell 2.

The case 8 of the ventilator unit having the intermediate wall 14, the support member 16 and the flow guide plates 18 can be molded from plastics in the form of suitably divided pieces. The divided pieces are assembled into the unit in which the air passing means 9 including the motor 22 and the fan 24 is accommodated in the case 8.

The ventilator of the first embodiment operates in the following manner. When a rider wearing the helmet 1 drives a motorcycle, the switch 26 on the power supply means 25 is manipulated to energize the motor 22. If the motor 22 is driven in the forward direction, The fan 24 draws atmospheric air into the case 8 through the outside opening 12 and forces the air against the inner surface of the face shield. Thus the air passing means 9 serves as a blower. The atmospheric air is cleaned by the filter 13, then introduced into the case 8 through the aperture 15, directed by the guide plates 18 and forced out from the inside opening 11 against the inner surface of the face shield 3 uniformly. The air thus applied is discharged from the clearances 27 at opposite side ends of the shield along with the air within the space between the shield 3 and the face of the wearer. Accordingly the air flows from the inside opening 11 of the case 8 to the clearances 27 as indicated by arrows in FIGS. 5 and 6, forming streams along the inner surface of the face shield 3.

When the motor 22 is driven in the reverse direction by manipulating the switch 26, the fan 24 forces out air from the space 29 between the face shield and the face and discharges the air from the outside opening of the case 8. Thus the air passing means 9 provides an induced draft fan or blower. With a reduced pressure produced in the space 29, atmospheric air flows into the space 29 through the clearances 27 and then into the inside opening 11 of the case in a direction reverse to the above-mentioned arrows, forming streams along the inner surface of the face shield 3.

Figure 7:
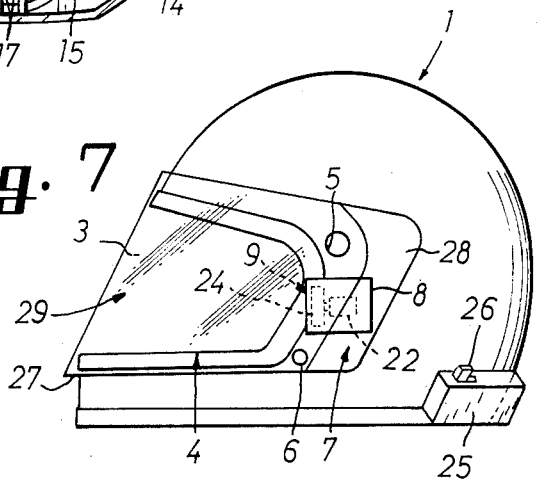
FIG. 7 is an overall side elevation showing a helmet equipped with ventilators according to a second embodiment of the invention.

FIG. 7 shows a second embodiment of the invention, wherein a pair of ventilator units 7 is disposed at opposite side ends of a face shield 3 between the shield and a helmet shell 2. Each ventilator unit 7, which generally has the same construction as the one already described, comprises a case 8 having inside and outside openings and air passing means 9 housed in the case 8 and including an electric motor 22 and a fan 24. Although not shown, the helmet shell 2 is preferably formed with a recessed portion for accommodating the unit 7 therein fixedly so that the unit will not interfere with the face shield 3 when the shield is opened or closed. A clearance 27 is formed between the lower edge of the shield 3 and a protector portion 2*a*. With the exception of the above feature, the second embodiment basically has the same construction as the first as will be readily understood. The second embodiment also operates generally in the same manner as the foregoing embodiment. When the motor 22 is rotated forward by manipulating a switch 26 on power supply means 25, the fan 24 supplies atmospheric air to the inside of the face shield 3 through the case 8 and discharges the air from the clearance 27 under the lower edge of the shield. Accordingly the air passing means 9 serves as a blower in this case. If the motor 22 is rotated reversely by the switch 26, the air inside the shield is drawn into the case 8 and immediately discharged from the case by the fan 24, causing atmospheric air to flow into the space inside the shield from the clearance 27 under the lower edge of the shield. Accordingly the air passing means 9 serves as an induced draft blower in this case. In either case, the air flowing between the clearance 27 and each of the ventilator units 7, 7 forms a stream along the inner surface of the shield 3.

FIG. 8 and FIG. 9 show a third embodiment of the invention, wherein a helmet 1 has a visor 30 projecting forward above its opening 4 and fixed at opposite ends to the shell 2 of the helmet by rivets or like fasteners 31. A face shield 3 is bulged from the opening 4 and pivoted at opposite end upper corners to the shell 2 by pins 5 to open and close the opening 4. The shield 3 has snap means 6, by which it is locked in its closed position. The shield 3 has an upper edge lapping over the outer edge of the visor 30 and is slidable on the outer edge of the visor 30 for opening or closing. A small clearance 27 is formed between the lower edge of the shield 3 and a protector portion 2*a* of the shell 2. Air passing means 9 is housed in the visor 30, so that the visor 30 itself serves as a case for the ventilator. Thus the assembly of the visor and the ventilator is in the form of a unit 7. The air passing means 9 includes a fan 24 and an electric motor 22 which is connected to power supply means 25. Preferably the power supply means 25 is also housed in the visor 30, with a switch 26 exposed from the top wall of the visor. The fan 24 of the means 9 is exposed to the space 29 between the shield 3 and the face of the wearer. Opposed to the air passing means 9 are air ports 32 in the form of slits and formed in the top wall of the visor 30. The space 29 communicates with the atmosphere through the air ports 32. The visor 30, serving as the case of the ventilator unit 7, may be attached to the upper portion of the face shield 3 instead of being fixed to the helmet shell 2. The third embodiment operates in the following manner. When the motor 22 is driven forward by manipulating the switch 26 of the power supply means 25, the fan 24 causes atmospheric air to flow into the space inside the shield 3 through the air ports 32 and discharges the air from the clearance 27 under the lower edge of the shield. Accordingly the air passing means 9 serves as a blower in this case. If the motor 22 is rotated reversely by the switch 26, the air inside the shield is forced out through the air ports 32 by the fan 24, causing atmospheric air to flow into the space inside the shield from the clearance 27 under the lower edge of the shield. Accordingly the air passing means 9 serves as an induced draft blower in this case. In either case, the air flowing between the clearance 27 and the air ports 32 forms a stream along the inner surface of the shield 3.

The present invention is not limited to the foregoing embodiments but can be modified variously within the scope of the invention set forth in the appended claims. For example, the reversibly rotatable motors included in the above embodiments can be those rotatable only in one direction when so desired.

What is claimed is:

1. A helmet having a shell, a face shield at an opening in the shell, a protector portion positionable at the chin of a wearer, and a ventilator located in the protector portion, for ventilating the space between the face shield and the face of the wearer of the helmet, the ventilator comprising a case attached to the shell of the helmet and having an inside opening open to the inside of the face shield and an outside opening communicating with the inside opening and open to the outside the helmet, and air passing means including an electric motor and a fan in the case for causing the air flowing through the space to form a stream along the inner surface of the face shield, wherein the air passing means forms a blower for drawing atmospheric air into the case through the outside opening and supplying the air to the inner surface of the face shield from the inside opening, wherein a clearance is formed at each side end of the face shield between the face shield and the helmet shell to serve as a vent, whereby the air supplied by the blower forms a stream flowing along the inner surface of the face shield and is discharged from the vent.

2. A helmet as defined in claim 1 or 7 wherein the case is provided with a plurality of flow guide plates arranged at its inside openingly laterally thereof at a spacing for forcing out the air from the inside opening uniformly against the inner surface of the face shield.

3. A helmet as defined in claim 2 wherein the ventilator is in the form of a unit having the air passing means incorporated in the case, and the unit is mounted on the protector portion of the helmet.

4. A helmet as defined in claim 8 wherein each of the ventilators is in the form of a unit having the air passing means incorporated in the case, and the unit is fixedly accommodated in a recessed portion formed in the helmet shell.

5. A helmet as defined in claim 4 wherein the air passing means provides a blower for drawing atmospheric air into the case through the outside opening and supplying the air to the inner surface of the face shield from the inside opening, and the air supplied by the blower forms a stream flowing along the inner surface of the face shield and discharged from the clearance.

6. A helmet as defined in claim 4 wherein the air passing means provides an induced draft blower for forcing out air from the space through the inside opening of the case and discharging the air from the outside opening, and air forced in through the clearance by the induced draft blower forms a stream flowing along the inner surface of the face shield and discharged through the case.

7. A helmet having a shell, a face shield at an opening in the shell, a protector portion positionable at the chin of a wearer, and a ventilator located in the protector portion, for ventilating the space between the face shield and the face of the wearer of the helmet, the ventilator comprising a case attached to the shell of the helmet and having an inside opening open to the inside of the face shield and an outside opening communicating with the inside opening and open to the outside of the helmet, and air passing means including an electric motor, and a fan in the case, for causing the air flowing through the space to form a stream along the inner surface of the face shield, the air passing means forming an induced draft blower for forcing out air from the space through the inside opening of the case and discharging the air from the outside opening, wherein a clearance is formed at each side end of the face shield between the face shield and the helmet shell to serve as an atmospheric air intake, whereby air forced in through the intake by the induced draft blower forms a stream flowing along the inner surface of the face shield and discharged through the case.

8. A helmet having a shell, a face shield at an opening in the shell, a protector portion positionable at the chin of the wearer, wherein a clearance is formed between the lower edge of the face shield and the protector portion, and a pair of ventilators positioned at opposite side ends of the face shield between the face shield and the shell, for ventilating the space between the face shield and the face of the wearer of the helmet, wherein air flows between the clearance and each of the ventilators, the ventilators each comprising a case attached to the shell of the helmet and having an inside opening open to the inside of the face shield and an outside opening communicating with the inside opening and open to the outside of the helmet, and air passing means including an electric motor, and a fan in the case, for causing the air flowing through the space to form a stream along the inner surface of the face shield.

* * * * *